US012049748B2

(12) United States Patent
Oberhart

(10) Patent No.: US 12,049,748 B2
(45) Date of Patent: Jul. 30, 2024

(54) ANTI-URINE SPLATTERING SYSTEM FOR TOILETS AND URINALS

(71) Applicant: Philip Oberhart, Los Altos, CA (US)

(72) Inventor: Philip Oberhart, Los Altos, CA (US)

( * ) Notice: Subject to any disclaimer, the term of this patent is extended or adjusted under 35 U.S.C. 154(b) by 105 days.

(21) Appl. No.: 18/080,010

(22) Filed: Dec. 13, 2022

(65) Prior Publication Data

US 2024/0191488 A1 Jun. 13, 2024

(51) Int. Cl.
*E03D 13/00* (2006.01)

(52) U.S. Cl.
CPC ..... *E03D 13/005* (2013.01)

(58) Field of Classification Search
CPC ..... E03D 13/005
USPC ..... 4/300.3, 415; 239/461; 210/285
See application file for complete search history.

(56) References Cited

U.S. PATENT DOCUMENTS 2,358,559 A * 9/1944 Clemens ..... C02F 1/16 261/115
6,061,843 A * 5/2000 Rump ..... E03C 1/057 4/302
6,698,035 B1 * 3/2004 Grueser ..... E03D 13/005 4/301
9,045,887 B2 * 6/2015 O'Malley ..... E03D 11/10
9,822,518 B1 * 11/2017 Arriaga ..... E03D 9/00
D935,581 S 11/2021 Lee
11,920,334 B1 * 3/2024 Archibald ..... E03D 9/00
2004/0237181 A1 * 12/2004 Atkins-Williams ..... E03D 11/025 4/300.3
2005/0235405 A1 * 10/2005 Dolle ..... E03D 9/00 4/300.3
2007/0266486 A1 * 11/2007 Ramirez ..... E03D 13/005 4/309
2014/0283292 A1 * 9/2014 McKnight ..... E03D 13/002 4/309
2015/0047114 A1 * 2/2015 Ramirez ..... E03D 9/00 4/300.3
2015/0308091 A1 10/2015 Foust
2018/0209127 A1 * 7/2018 Cobb ..... E03D 5/04
2019/0345708 A1 * 11/2019 Kuroki ..... E03D 11/08
2020/0354939 A1 * 11/2020 Lin ..... E03D 13/00
2020/0407961 A1 * 12/2020 Castro Zapata ..... E03D 11/10

FOREIGN PATENT DOCUMENTS

CN 109162337 A * 1/2019 ..... G06F 16/00
WO WO-2007081519 A2 * 7/2007 ..... G06F 16/00
WO WO-2019171307 A1 * 9/2019 ..... E03D 11/10

* cited by examiner

*Primary Examiner* — Lori L Baker
(74) *Attorney, Agent, or Firm* — Kyle A. Fletcher, Esq.

(57) ABSTRACT

The anti-urine splattering system for toilets and urinals comprises a sanitary plumbing fixture, a spray head, a first valve, an electronic controller, and an activation control. The spray head may be operable to create a water curtain across an aperture of the sanitary plumbing fixture. The water curtain may prevent splashed urine from exiting the sanitary plumbing fixture during urination. The electronic controller may initiate the water curtain responsive to input from the activation control. The electronic controller may initiate the water curtain by electrically actuating the first valve. In some embodiments, the spray head may be supplied with water from a supplemental water tank via a second valve. As non-limiting examples, the sanitary plumbing fixture may be a toilet or a urinal.

20 Claims, 6 Drawing Sheets

ANTI-URINE SPLATTERING SYSTEM FOR TOILETS AND URINALS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of sanitary plumbing fixtures, more specifically, an anti-urine splattering system for toilets and urinals.

SUMMARY OF INVENTION

The anti-urine splattering system for toilets and urinals comprises a sanitary plumbing fixture, a spray head, a first valve, an electronic controller, and an activation control. The spray head may be operable to create a water curtain across an aperture of the sanitary plumbing fixture. The water curtain may prevent splashed urine from exiting the sanitary plumbing fixture during urination. The electronic controller may initiate the water curtain responsive to input from the activation control. The electronic controller may initiate the water curtain by electrically actuating the first valve. In some embodiments, the spray head may be supplied with water from a supplemental water tank via a second valve. As non-limiting examples, the sanitary plumbing fixture may be a toilet or a urinal.

An object of the invention is to provide a sanitary plumbing fixture for capturing and disposing of at least urine.

Another object of the invention is to provide a spray head that is shaped and positioned adjacent to an aperture of the sanitary plumbing fixture to create a water curtain.

A further object of the invention is to activate the water curtain during urination using an electronic controller and first valve to prevent splashed urine from exiting the sanitary plumbing fixture.

Yet another object of the invention is to provide a supplemental water tank and a second valve to provide water for the water curtain.

These together with additional objects, features and advantages of the anti-urine splattering system for toilets and urinals will be readily apparent to those of ordinary skill in the art upon reading the following detailed description of the presently preferred, but nonetheless illustrative, embodiments when taken in conjunction with the accompanying drawings.

In this respect, before explaining the current embodiments of the anti-urine splattering system for toilets and urinals in detail, it is to be understood that the anti-urine splattering system for toilets and urinals is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the anti-urine splattering system for toilets and urinals.

It is therefore important that the claims be regarded as including such equivalent construction insofar as they do not depart from the spirit and scope of the anti-urine splattering system for toilets and urinals. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
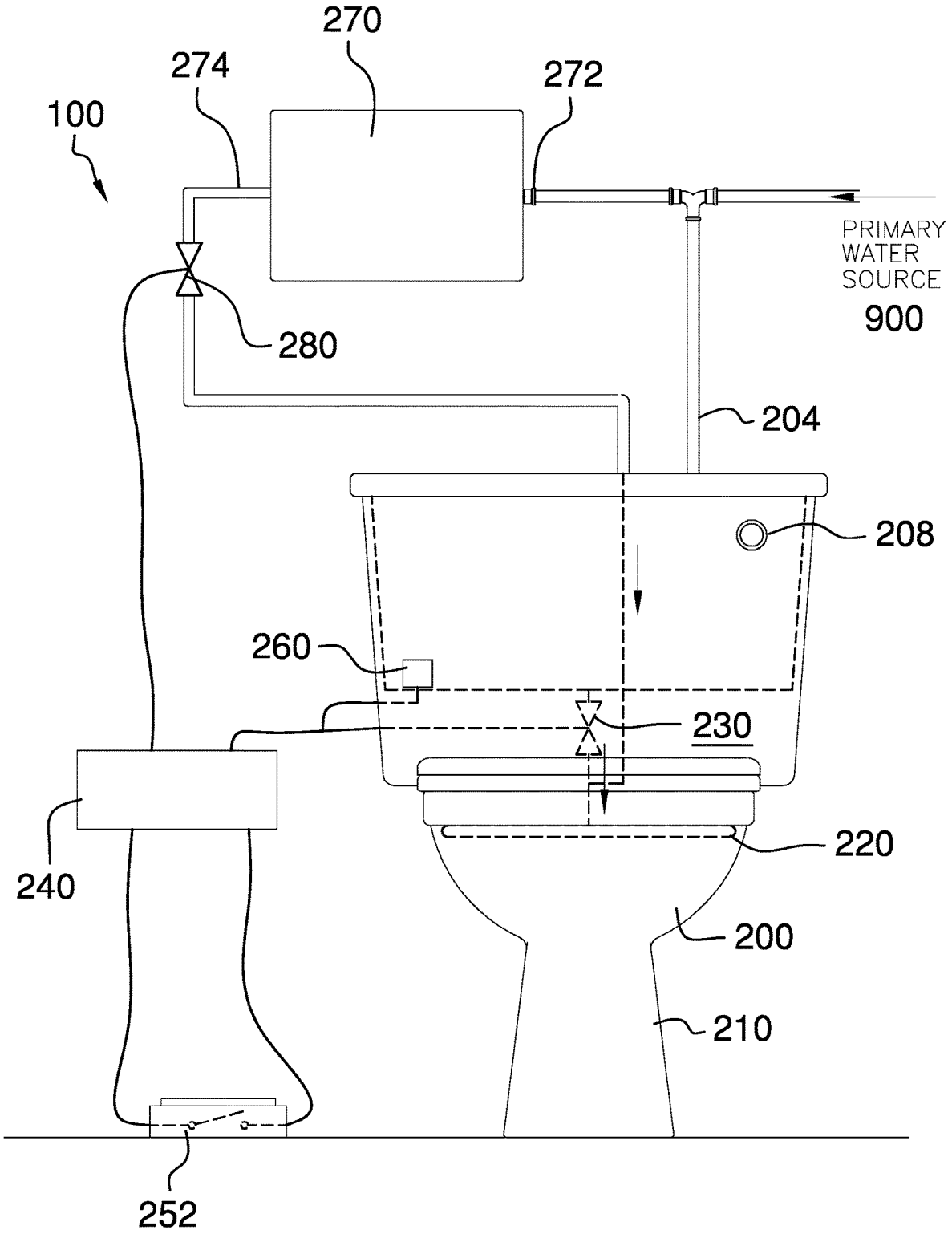
FIG. 1 is a front view of an embodiment of the disclosure.
Figure 2A:
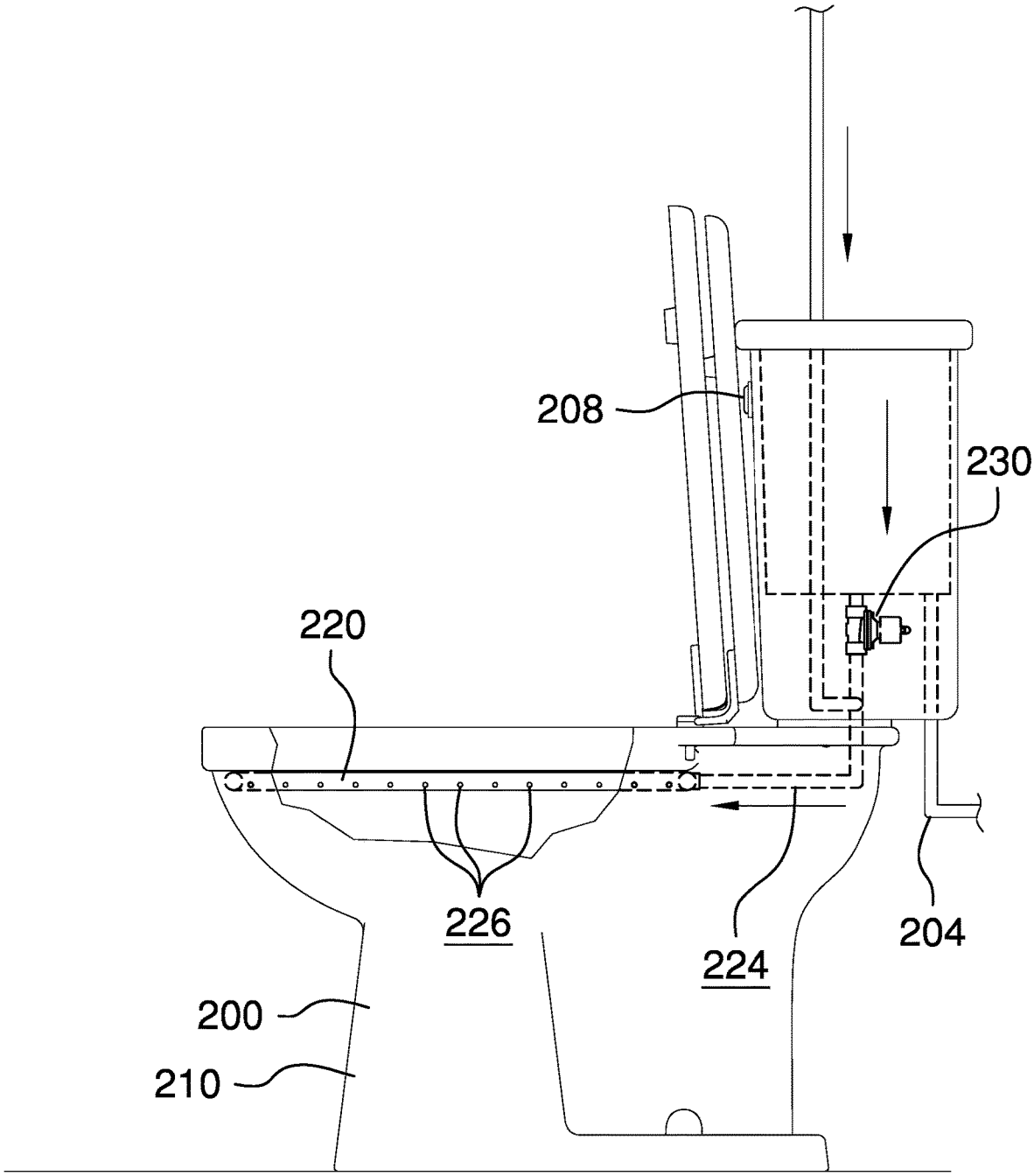
FIG. 2A is a side detail view of an embodiment of the disclosure, illustrating water for the water curtain supplied from the toilet tank.
Figure 2B:
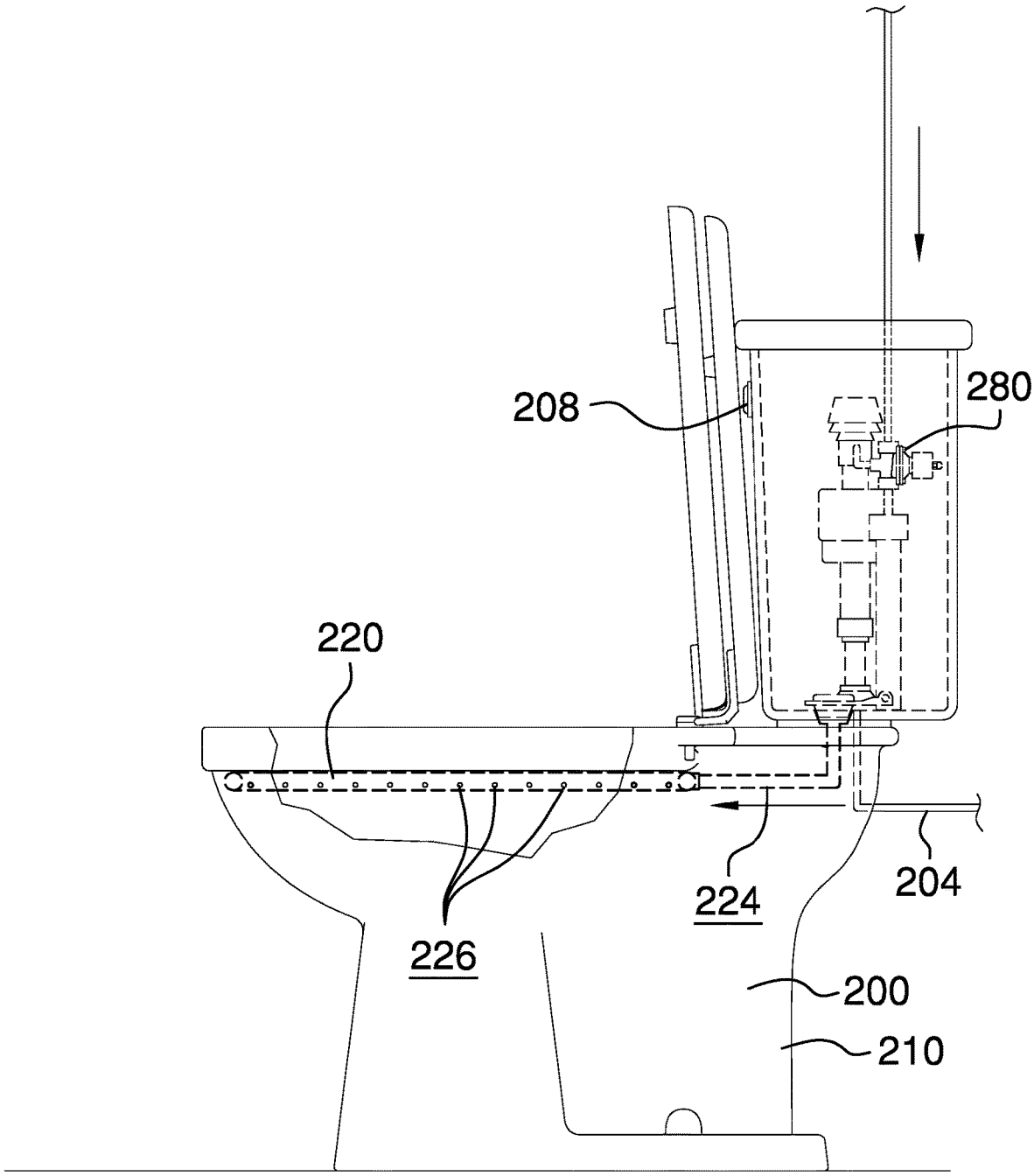
FIG. 2B is a side detail view of an embodiment of the disclosure, illustrating water for the water curtain supplied from a supplemental water tank.
Figure 3A:
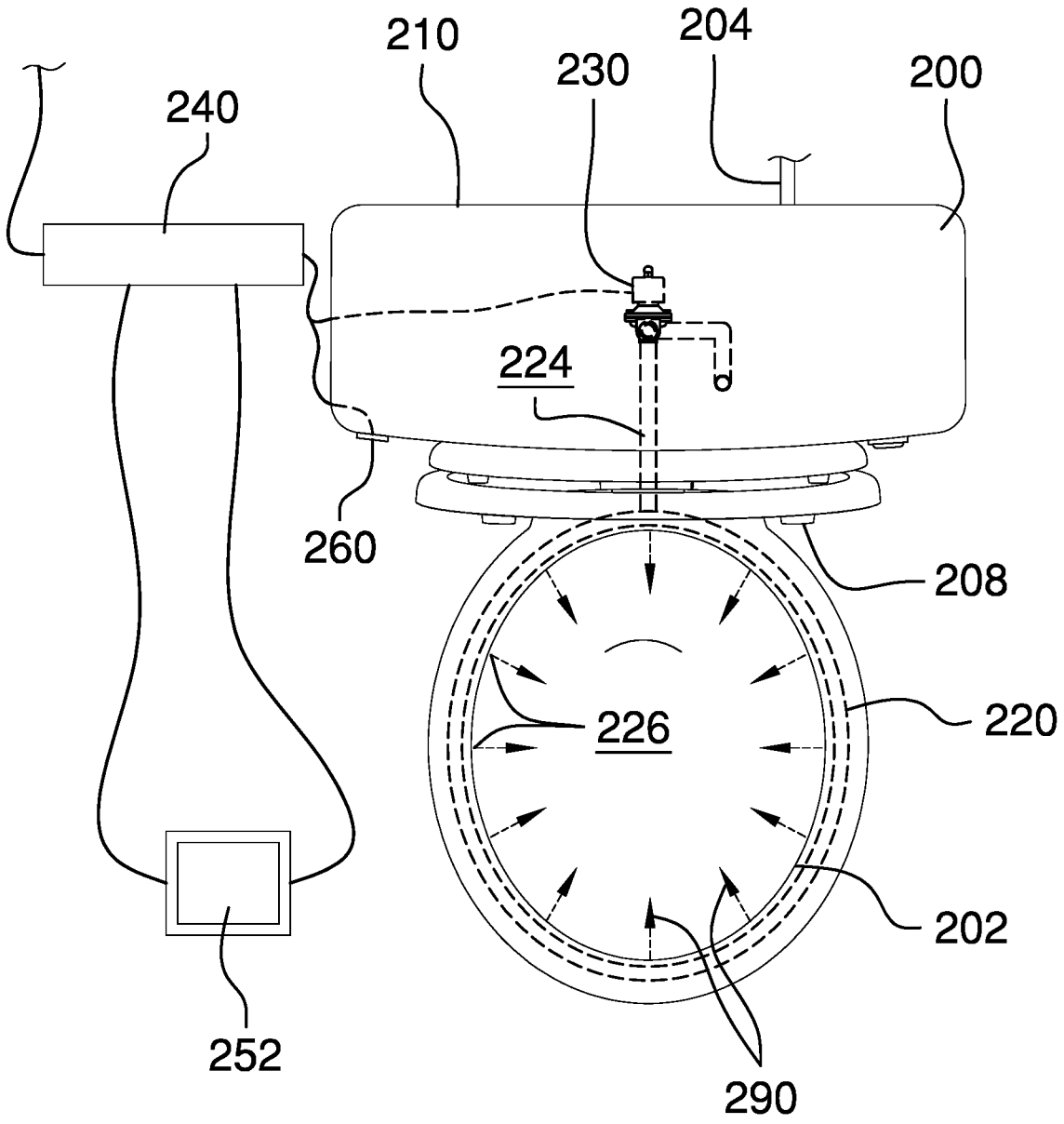
FIG. 3A is a top view of an embodiment of the disclosure, illustrating water for the water curtain supplied from the toilet tank.
Figure 3B:
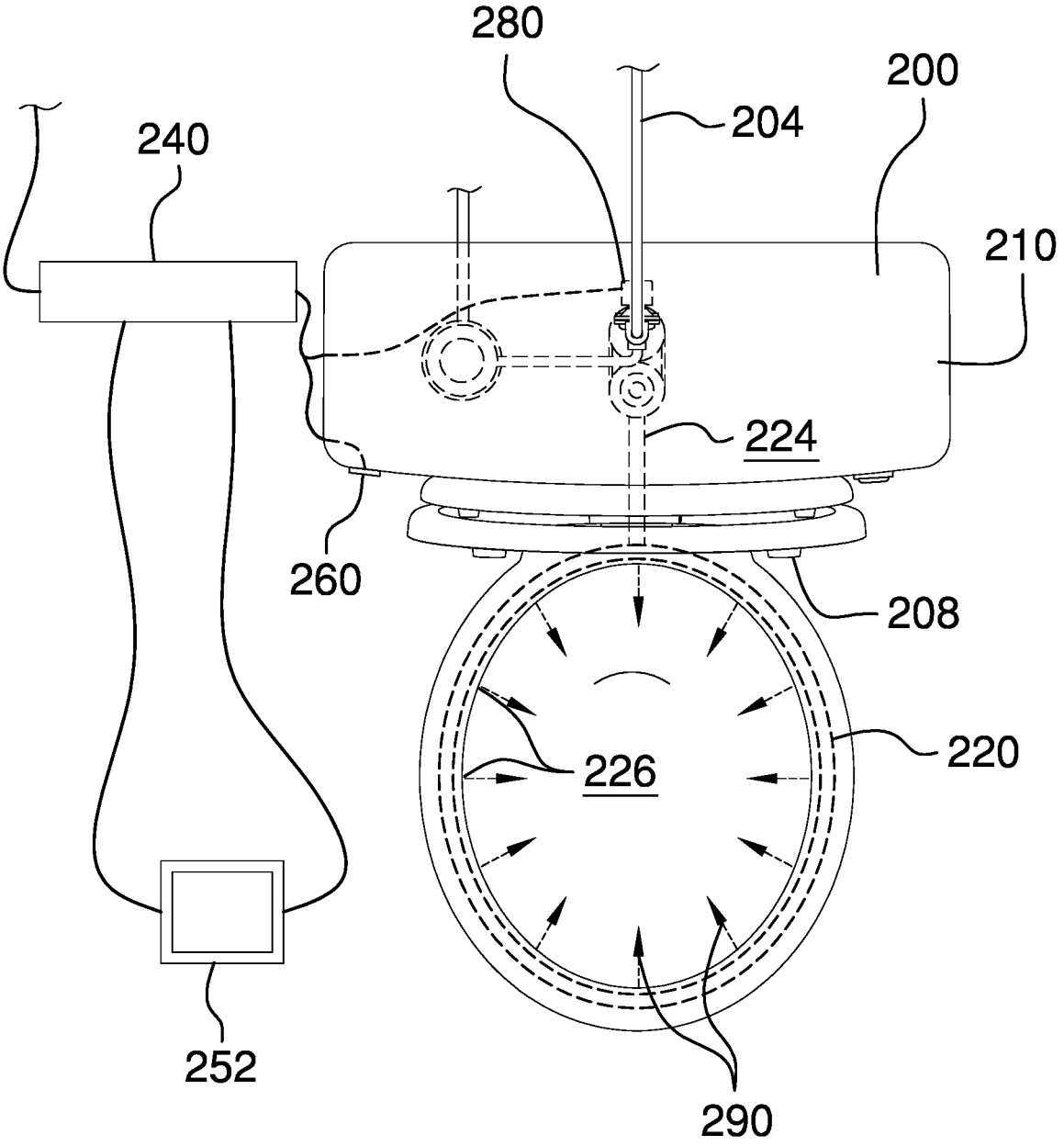
FIG. 3B is a top view of an embodiment of the disclosure, illustrating water for the water curtain supplied from a supplemental water tank.
Figure 4:
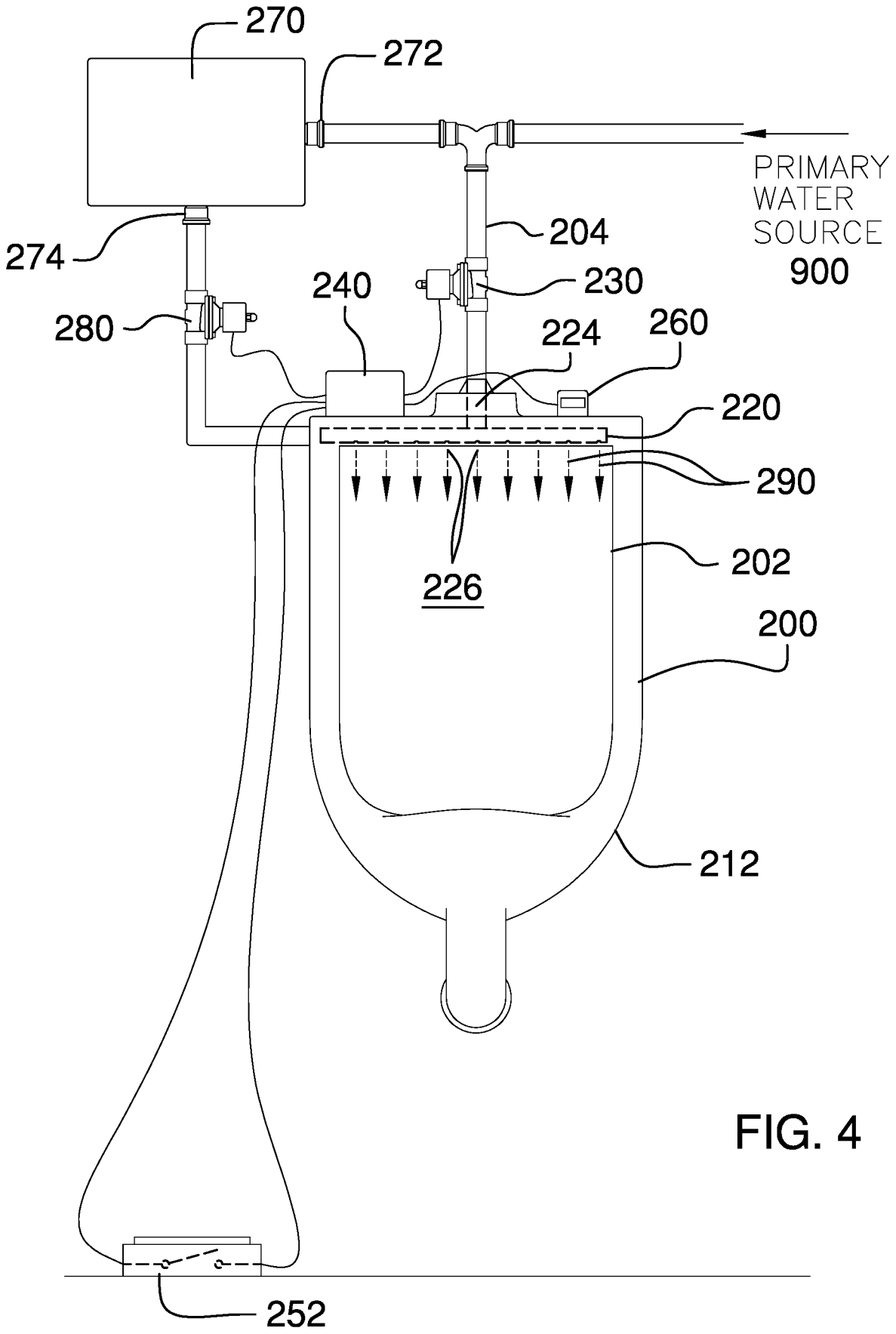
FIG. 4 is a front view of an alternative embodiment of the disclosure, illustrating the water curtain on a urinal.

Detailed reference will now be made to a first potential embodiment of the disclosure, which is illustrated in FIGS. 1 through 4.

The anti-urine splattering system for toilets and urinals 100 (hereinafter invention) comprises a sanitary plumbing fixture 200, a spray head 220, a first valve 230, an electronic controller 240, and an activation control. The spray head 220 may be operable to create a water curtain 290 across an aperture 202 of the sanitary plumbing fixture 200. The water curtain 290 may prevent splashed urine from exiting the sanitary plumbing fixture 200 during urination. The electronic controller 240 may initiate the water curtain 290 responsive to input from the activation control. The electronic controller 240 may initiate the water curtain 290 by electrically actuating the first valve 230. As non-limiting examples, the sanitary plumbing fixture 200 may be a toilet 210 or a urinal 212.

The sanitary plumbing fixture 200 may be adapted to collect urine and to flush the urine into a drain using water. The sanitary plumbing fixture 200 may be configured for the urine to enter the sanitary plumbing fixture 200 through the aperture 202. For the toilet 210, the aperture 202 may be the open top of a toilet bowl. For the urinal 212, the aperture 202 may be the open front of the urinal 212. The water for flushing may be provided to the sanitary plumbing fixture 200 from a water source 900 via a water supply connection 204. The sanitary plumbing fixture 200 may be configured to flush the urine into a sewer line via the drain responsive to activation of a flush handle 208. In some embodiments, the flush handle 208 may be a push button.

The spray head 220 may be a conduit having a water inlet 224 and a plurality of water outlet apertures 226. The water may enter the spray head 220 from the water source 900 via the water inlet 224. The spray head 220 may be shaped and positioned on the sanitary plumbing fixture 200 to create the water curtain 290 from the water flowing through the spray head 220. The plurality of water outlet apertures 226 may be oriented to spray the water across the aperture 202. The water curtain 290 may deflect the splashed urine and may prevent the splashed urine from exiting the sanitary plumbing fixture 200. As a non-limiting example, the spray head 220 may be a circular conduit surrounding the top of the toilet bowl on the toilet 210. As a further non-limiting example, the spray head 220 may be a linear conduit located at the top of the urinal 212.

In some embodiments, the water source 900 may be the water held in a toilet tank for flushing the sanitary plumbing fixture 200.

The flow of the water into the spray head 220 may be gated by the first valve 230. The first valve 230 may permit the water to flow into the spray head 220 in the open state and may prevent the water from flowing into the spray head 220 in the closed state. The open/closed state of the first valve 230 may be controlled by the electronic controller 240.

The electronic controller 240 may electrically communicate with the first valve 230 and the activation control in order to sense and control the operation of the water curtain 290. The electronic controller 240 may initiate the water curtain 290 responsive to input from the activation control. The electronic controller 240 may comprise an internal timer and may terminate the water curtain 290 based upon timing.

The activation control may be adapted to request initiation of the water curtain 290. The activation control may comprise a foot switch 252, one or more sensors 260, or any combination thereof.

The foot switch 252 may be a foot-activated switch located on a floor adjacent to the sanitary plumbing fixture 200. The foot switch 252 may be adapted for a user to press down on with a foot in order to signal the electronic controller 240. Responsive to activation of the foot switch 252, the electronic controller 240 may initiate the water curtain 290 by opening the first valve 230.

The one or more sensors 260 may be adapted to sense the presence of the user and to signal said presence to the electronic controller 240. As non-limiting examples, an individual sensor selected from the one or more sensors 260 may be adapted to sense the presence of the user based upon light attributes, thermal attributes, motion attributes, or any combination thereof. The electronic controller 240 may determine that the luminosity in front of the individual sensor has changed or has crossed a predetermined luminosity threshold and may initiate the water curtain 290. The electronic controller 240 may determine that the heat signature in front of the individual sensor has changed or has crossed a predetermined heat threshold and may initiate the water curtain 290. The electronic controller 240 may determine that picture elements have changed within the field of view of the individual sensor indicating motion in front of the individual sensor and may initiate the water curtain 290.

In some embodiments, the invention 100 may comprise a supplemental water tank 270 and a second valve 280. The supplemental water tank 270 may supply the water for the water curtain 290 that is independent of the water used for flushing the sanitary plumbing fixture 200. The second valve 280 may gate the water from the supplemental water tank 270 to the spray head 220.

The supplemental water tank 270 may comprise a supplemental water inlet 272 that may be fluidly coupled to the water source 900 such that the supplemental water tank 270 may fill with water. The supplemental water tank 270 may comprise a supplemental water outlet 274 such that the water may exit the supplemental water tank 270 and flow to the second valve 280.

The flow of the water into the spray head 220 may be gated by the second valve 280. The second valve 280 may permit the water to flow into the spray head 220 in the open state and may prevent the water from flowing into the spray head 220 in the closed state. The open/closed state of the second valve 280 may be controlled by the electronic controller 240.

In some embodiments, the water arriving at the spray head 220 may be sourced through both the first valve 230 and/or the second valve 280. As a non-limiting example, the plumbing from the first valve 230 and the second valve 280 may join at a T or Y joint. Sourcing the water at both the first valve 230 and the second valve 280 may enable the electronic controller 240 to provide the water curtain 290 during urination both prior to flushing and during flushing.

In use, the user may approach the sanitary plumbing fixture 200 and may activate the water curtain 290. In some embodiments, the user may activate the water curtain 290 explicitly by pressing down on the foot switch 252 or implicitly by simply approaching the sanitary plumbing fixture 200 and triggering the one or more sensors 260. As the user urinates, some of the urine may strike an internal surface of the sanitary plumbing fixture 200 and splash back towards the aperture 202. The splashed urine may encounter the water curtain 290 and be deflected back into the sanitary plumbing fixture 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, the term "flush" may be used to describe that a first surface is aligned with a second surface.

As used in this disclosure, the "foot" may refer to the portion of the leg that is below the ankle. Within this disclosure, the foot is further defined with a forefoot, a midfoot and a hindfoot. The forefoot is the region of the foot is the anterior portion of the foot within which the phalanges and the metatarsals bones are located. The midfoot is the region of the foot within which the navicular, cuboid, and cuneiform bones are located. The hindfoot is the region of the foot that is posterior to the midfoot.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "sensor" may be a device that quantitatively measures a physical stimulus.

As used in this disclosure, a "spray" may be a plurality of liquid drops projected from a nozzle.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used in this disclosure, a "urinal" may be a port into which human excretions are deposited for in preparation of introducing the excretions into an externally provided waste water handling system.

As used in this disclosure, a "valve" may be a device that is used to control the flow of a fluid, either gas or liquid, through a pipe or to control the flow of a fluid into and out of a container. Some valves may have multiple ports and may allow the diverting or mixing of fluids.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An anti-urine splattering system for toilets and urinals comprising:

a sanitary plumbing fixture, a spray head, a first valve, an electronic controller, and an activation control;

wherein the spray head is operable to create a water curtain across an aperture of the sanitary plumbing fixture;

wherein the water curtain prevents splashed urine from exiting the sanitary plumbing fixture during urination;

wherein the electronic controller initiates the water curtain responsive to input from the activation control;

wherein the electronic controller initiates the water curtain by electrically actuating the first valve.

2. The anti-urine splattering system for toilets and urinals according to claim 1 wherein the sanitary plumbing fixture is a toilet or a urinal.

3. The anti-urine splattering system for toilets and urinals according to claim 2 wherein the sanitary plumbing fixture is adapted to collect urine and to flush the urine into a drain using water;

wherein the sanitary plumbing fixture is configured for the urine to enter the sanitary plumbing fixture through the aperture;

wherein the water for flushing is provided to the sanitary plumbing fixture from a water source via a water supply connection;

wherein the sanitary plumbing fixture is configured to flush the urine into a sewer line via the drain responsive to activation of a flush handle.

4. The anti-urine splattering system for toilets and urinals according to claim 3 wherein the spray head is a conduit having a water inlet and a plurality of water outlet apertures;

wherein the water enters the spray head from the water source via the water inlet;

wherein the spray head is shaped and positioned on the sanitary plumbing fixture to create the water curtain from the water flowing through the spray head;

wherein the plurality of water outlet apertures are oriented to spray the water across the aperture;

wherein the water curtain deflects the splashed urine and prevents the splashed urine from exiting the sanitary plumbing fixture.

5. The anti-urine splattering system for toilets and urinals according to claim 4 wherein the spray head is a circular conduit surrounding the top of the toilet bowl on the toilet.

6. The anti-urine splattering system for toilets and urinals according to claim 4 wherein the spray head is a linear conduit located at the top of the urinal.

7. The anti-urine splattering system for toilets and urinals according to claim 4 wherein the water source is the water held in a toilet tank for flushing the sanitary plumbing fixture.

8. The anti-urine splattering system for toilets and urinals according to claim 4 wherein the flow of the water into the spray head is gated by the first valve;

wherein the first valve permits the water to flow into the spray head in the open state and prevents the water from flowing into the spray head in the closed state;

wherein the open/closed state of the first valve is controlled by the electronic controller.

9. The anti-urine splattering system for toilets and urinals according to claim 8 wherein the electronic controller electrically communicates with the first valve and the activation control in order to sense and control the operation of the water curtain;

wherein the electronic controller initiates the water curtain responsive to input from the activation control;

wherein the electronic controller comprises an internal timer and terminates the water curtain based upon timing.

10. The anti-urine splattering system for toilets and urinals according to claim 9 wherein the activation control is adapted to request initiation of the water curtain;

wherein the activation control comprises a foot switch, one or more sensors, or any combination thereof.

11. The anti-urine splattering system for toilets and urinals according to claim 10 wherein the foot switch is a foot-activated switch located on a floor adjacent to the sanitary plumbing fixture;

wherein the foot switch is adapted for a user to press down on with a foot in order to signal the electronic controller;

wherein responsive to activation of the foot switch, the electronic controller initiates the water curtain by opening the first valve.

12. The anti-urine splattering system for toilets and urinals according to claim 10 wherein the one or more sensors are adapted to sense the presence of the user and to signal said presence to the electronic controller.

13. The anti-urine splattering system for toilets and urinals according to claim 12 wherein an individual sensor selected from the one or more sensors is adapted to sense the presence of the user based upon light attributes, thermal attributes, motion attributes, or any combination thereof.

14. The anti-urine splattering system for toilets and urinals according to claim 13 wherein the electronic controller determines that the luminosity in front of the individual sensor has changed or has crossed a predetermined luminosity threshold and initiates the water curtain.

15. The anti-urine splattering system for toilets and urinals according to claim 13 wherein the electronic controller determines that the heat signature in front of the individual sensor has changed or has crossed a predetermined heat threshold and initiates the water curtain.

16. The anti-urine splattering system for toilets and urinals according to claim 13 wherein the electronic controller determines that picture elements have changed within the field of view of the individual sensor indicating motion in front of the individual sensor and initiates the water curtain.

17. The anti-urine splattering system for toilets and urinals according to claim 10 wherein the anti-urine splattering system for toilets and urinals comprises a supplemental water tank and a second valve;

wherein the supplemental water tank supplies the water for the water curtain that is independent of the water used for flushing the sanitary plumbing fixture;

wherein the second valve gates the water from the supplemental water tank to the spray head.

18. The anti-urine splattering system for toilets and urinals according to claim 17 wherein the supplemental water tank comprises a supplemental water inlet that is fluidly coupled to the water source such that the supplemental water tank fills;

wherein the supplemental water tank comprises a supplemental water outlet such that the water exits the supplemental water tank and flows to the second valve.

19. The anti-urine splattering system for toilets and urinals according to claim 18 wherein the flow of the water into the spray head is gated by the second valve;

wherein the second valve permits the water to flow into the spray head in the open state and prevents the water from flowing into the spray head in the closed state;

wherein the open/closed state of the second valve is controlled by the electronic controller.

20. The anti-urine splattering system for toilets and urinals according to claim 19 wherein the water arriving at the spray head is sourced through the first valve and/or the second valve.

* * * * *